US005718363A

United States Patent [19]

Graves

[11] Patent Number: 5,718,363

[45] Date of Patent: Feb. 17, 1998

[54] FIREARM CARRIER

[75] Inventor: Gordon Graves, Hot Springs Village, Ark.

[73] Assignee: Evanwood Inc., Hot Springs, Ark.

[21] Appl. No.: 619,370

[22] Filed: Mar. 21, 1996

[51] Int. Cl.[6] ..... A45F 3/14; F41C 33/00; F41C 23/02

[52] U.S. Cl. ..... 224/250; 224/150; 224/243; 224/258; 224/901.4; 224/913; 224/578

[58] Field of Search ..... 224/913, 578, 224/150, 250, 243, 901.4, 917, 257, 258

[56] References Cited

U.S. PATENT DOCUMENTS

| | | | |
|---|---|---|---|
| 3,334,794 | 8/1967 | Saari et al. | 224/913 |
| 3,934,768 | 1/1976 | Jones | 224/913 |
| 4,863,083 | 9/1989 | Chen | 224/250 |
| 5,450,991 | 9/1995 | Neading | 224/578 |

FOREIGN PATENT DOCUMENTS

| | | | |
|---|---|---|---|
| 2577123 | 8/1986 | France | 224/258 |

*Primary Examiner*—Linda J. Sholl
*Attorney, Agent, or Firm*—Stephen D. Carver

[57] ABSTRACT

A firearm carrier for safely transporting firearms. The carrier transversely secures the firearm to a user's body while preventing accidental discharges of the firearm. The firearm carrier is particularly well suited for use on an ATV. The firearm carrier safely, temporarily attaches the firearm to the user's waist in a safe, stable transport configuration. The firearm carrier may also be used as a temporary shoulder sling. The firearm carrier comprises an elongated, adjustable belt that fits around the waist of the user. A quick release buckle system facilitates belt removal. A pair of spaced apart straps project downwardly from the belt. Preferably, the straps project downwardly along the front of the user's legs. Each strap extends to a terminal end. An intermediary leg projects from each strap. Preferably, the straps are appropriately covered by a hook and pile fasteners. The straps encircle the gun during deployment, forming a pair of retention loops that secure the gun to the user's waist. To attach the gun to the carrier, the gun is placed against the strap interior and the intermediary leg is looped over the gun. Then the terminal end is placed on top of the intermediary leg and tightly fastened to form a retention loop. A trigger guard system prevents an accidental discharge of the firearm. The trigger guard system optionally attaches to either of the straps about the respective retention loop. The trigger guard system prevents accidental discharge.

5 Claims, 4 Drawing Sheets

FIREARM CARRIER

BACKGROUND OF THE INVENTION

I. Field of the Invention

The present invention relates generally to firearm accessories. More specifically, the present invention relates primarily to belts for safely carrying firearms. The disclosed belt is particularly well suited to be used persons riding all-terrain vehicles (ATV's).

II. Description of the Prior Art

As will be recognized by those skilled in the art, firearms can be difficult to transport safely. Although the term firearm includes various types of weapons, the term firearm as used herein is intended to be restricted to rifles, shotguns, muzzle loaders and similar guns with elongated barrels. Such firearms are generally at least two feet in overall length.

Firearm transportation often becomes hazardous aboard vehicles. Transportation is especially problematic on all-terrain vehicles or ATV's because of their generally open structure and their other inherently dangerous attributes. As used herein the term "ATV" broadly encompasses both motorized and non-motorized vehicles including bicycles, motorcycle, 3-wheelers, 4 wheelers and the like. Three and/or four-wheeled self propelled, all-terrain vehicles are often used by hunters, outdoorsmen, naturalists or the like.

Several different devices have been commonly employed to promote gun transportation safety. The best known types of short-term transportation devices are probably conventional shoulder slings and gun racks. Several conventional storage devices, such as sheaths or scabbards and cases, have also been used as temporary firearm transportation devices.

Conventional shoulder slings are well-known in the prior art. Illustrative of these are U.S. Pat. Nos. 4,562,945; 3,627,181 and 3,595,451. Typical shoulder slings comprise straps which mount to the stock and forearm of a rifle or shotgun and normally retain the gun in a vertical orientation. Some slings also provide a degree of protection for the gun, such as those disclosed in Carter, U.S. Pat. No. 3,653,564 and Shindelka, U.S. Pat. No. 4,280,644, wherein a strap with a cup goes over the barrel and attaches to the stock of the gun.

A different type of sling arrangement, commonly called a gun caddy, uses a pocket on a belt to accept the butt of a shotgun or rifle. Typical gun caddies are shown in James, U.S. Pat. No. 4,911,345, Thompson, U.S. Pat. No. 2,778,552, Lyons, U.S. Pat. No. 3,422,497, and Pappas, U.S. Design Pat. 304,977.

Some more elaborate systems provide a similar pocket with a strap assembly either to provide support or to pivot the gun for use. These include Brown, U.S. Pat. No. 2,647,667, Gregson, U.S. Pat. No. 3,430,828, Vaughn, U.S. Pat. No. 3,700,147, and Roach, U.S. Pat. No. 3,869,074. Yet another caddy-type device aiding in the carrying of a gun is disclosed in U.S. Pat. No. 2,526,768 issued to Pendergrass.

Another type of sling/caddy combination provides a horizontal rest position for the firearm. This type of combination is shown in Easter, U.S. Pat. No. 5,029,741, and Brokus, U.S. Pat. No. 3,606,109. U.S. Pat. No. 4,964,553, to Glynn shows a firearm holding apparatus that attaches to the user's belt. However, the horizontal rest positions provided by these devices subject the gun to inadvertent movements and/or jostling unless the user stabilizes the gun by continuously holding a portion of it. In other words, the known prior art does not adequately secure the firearm in a horizontal position to prevent inadvertent movements and/or jostling that could cause an accidental discharge.

Vehicularly mounted gun racks are another common device used to transport firearms. On most ATV's, the racks mount upon the vehicle's front end. U.S. Pat. Nos. 4,915,273 and 4,607,772 issued to Allen and Hancock, respectively, disclose such gun racks.

And, of course, pistol holsters and the like for retaining pistols on a user's waist are well-known. Other tools are also often secured to the user's waist by conventional utility belts. Snyder, U.S. Pat. No. 4,923,105, discloses a utility belt with various velcro components. U.S. Pat. No. 5,060,835 issued to Payne discloses a belt employing a loop which is disposed in a horizontal fashion to hold a drink container. Ridings U.S. Pat. No. 4,621,753 discloses a tool carrier used with a belt. Additionally the same is true of Swinney U.S. Pat. No. 4,325,503. Webster U.S. Design Pat. 298,382 discloses a belt with pockets for carrying beverage cans. Ericksen, U.S. Design Pat. 291,623, shows a utility belt having beverage containers.

However, none of the above described prior art teaches an effective and safe method for transporting firearms on ATV's. Conventional slings, such as those shown in the aforementioned prior art, generally fail to perform satisfactorily in adverse conditions encountered while driving an ATV.

For example, conventional slings often leave the gun disposed transversely across the back of the driver. One of the problems associated with conventional slings is that the gun barrels often protrude above the head and shoulders of the driver, presenting difficulties when navigating dense underbrush. As can be easily imagined, the protruding gun barrel is often caught upon projecting limbs and can led to serious accidents. Even if the gun barrel protrusion alone doesn't cause significant problems, the resultant modification in ATV driving and handling abilities often do cause problems.

For instance, even the horizontal slings/caddies fail to perform satisfactorily because they require the user to hold the gun. However, steering the ATV generally requires both of the user's hands and their complete attention.

Conventional gun racks for most ATV's are also unacceptable in that they place the gun transversely across the front of the handlebars. This arrangement can lead to problems when trying to navigate through projecting limbs and underbrush, because the steering handles are often used to part the brush and such a function would be impeded by the need to protect the firearm from the brush and the dangers associated with a loaded weapon being accidentally discharged.

Therefore, a desirable firearm carrier provides a sheltered carrying configuration while preventing accidental discharge of the firearm. In particular, a desirable firearm carrier facilitates the simple removal and attachment to the firearm. An especially desirable firearm carrier substantially immobilizes the firearm during transport without requiring holding by the user. A firearm carrier should also prevent an accidental discharge of the firearm.

SUMMARY OF THE INVENTION

My firearm carrier overcomes the problems discussed hereinabove. The carrier transversely secures the firearm to the user's body while preventing accidental discharges of the firearm. The firearm carrier is particularly well suited for use on an ATV.

The firearm carrier safely, temporarily attaches the firearm to the user's waist in a safe, stable transport configuration. The firearm carrier is also adapted to be used as a temporary gun rest and it may also be used as a temporary shoulder sling. Of course, the typical user of the firearm carrier will be a hunter, but the carrier can be used by other individuals as well.

The firearm carrier comprises an elongated, adjustable belt that fits around the waist of the user. Preferably, the user adjusts the belt to snugly fit their waist. The belt may also be quickly adjusted to fit on the shoulder of the user. A quick release buckle system facilitates belt removal.

A pair of spaced apart straps project downwardly from the front of the belt. Preferably, the straps project downwardly along the front of the user's legs. Each strap extends to a terminal end. An intermediary leg projects from each strap. Preferably, the straps are appropriately covered by cooperative hook and pile mating cloth (VELCRO).

The straps encircle the gun during deployment to form a pair of retention loops that secure the gun to the user's waist. To attach the gun to the carrier, the gun is placed against the strap interior and the intermediary leg is looped over the gun. Then the terminal end is placed on top of the intermediary leg and tightly fastened to form the retention loop.

A trigger guard system prevents an accidental discharge of the firearm. The trigger guard system optionally attaches to either of the straps about the respective retention loop. The trigger guard system restricts access to the trigger, thus preventing an accidental discharge.

Thus a primary object of the present invention is to provide a firearm carrier that promotes safe transportation of firearms on ATV's.

A related object of the present invention is to provide a firearm carrier for a driver of an ATV.

A basic object of the present invention is to enable an ATV user to operate an ATV normally while transporting a firearm.

Another basic object of the present invention is to protect a firearm during transportation.

A related object of the present invention is to protect a firearm while it is being transported on an ATV.

Yet another basic object of the present invention is to prevent an accidental discharge of the firearm.

A related object of the present invention is to prevent an accidental discharge of the firearm during transportation.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
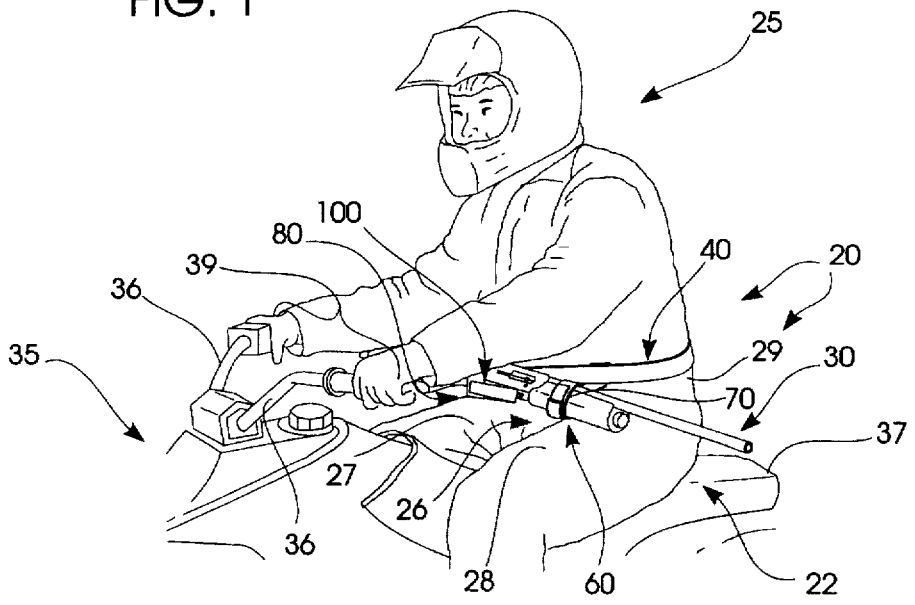
FIG. 1 is a pictorial view showing the firearm carrier deployed to secure a firearm to the waist of an ATV driver in a transport configuration.
Figure 2:
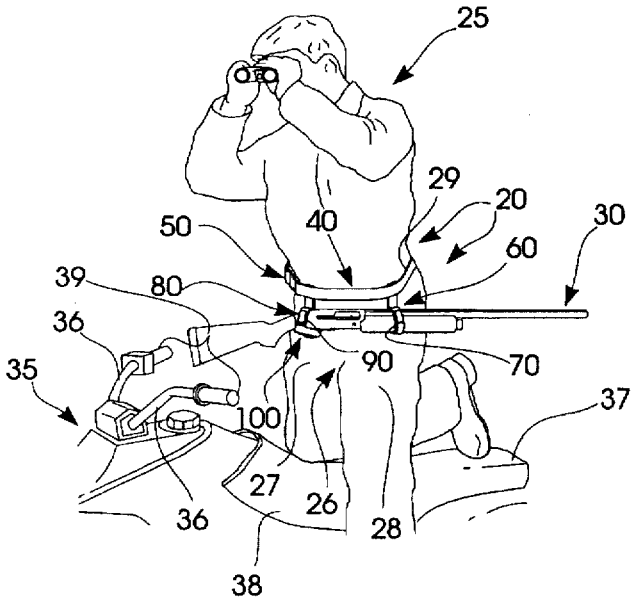
FIG. 2 is a pictorial view showing the firearm carrier deployed to secure a firearm to the waist of an ATV user.
Figure 3:
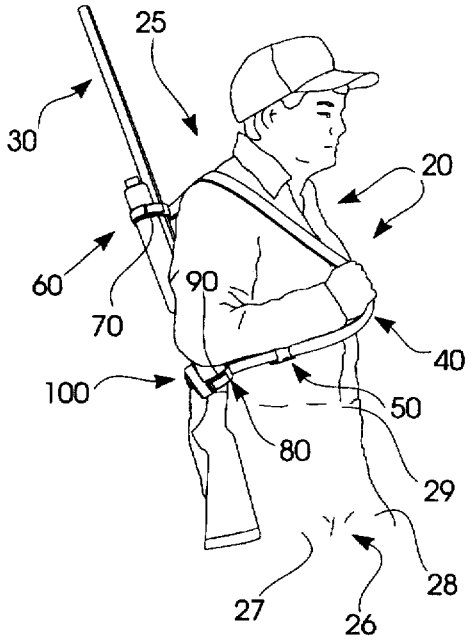
FIG. 3 is a pictorial view showing the firearm carrier securing a firearm and being temporarily used as a shoulder sling.
Figure 4:
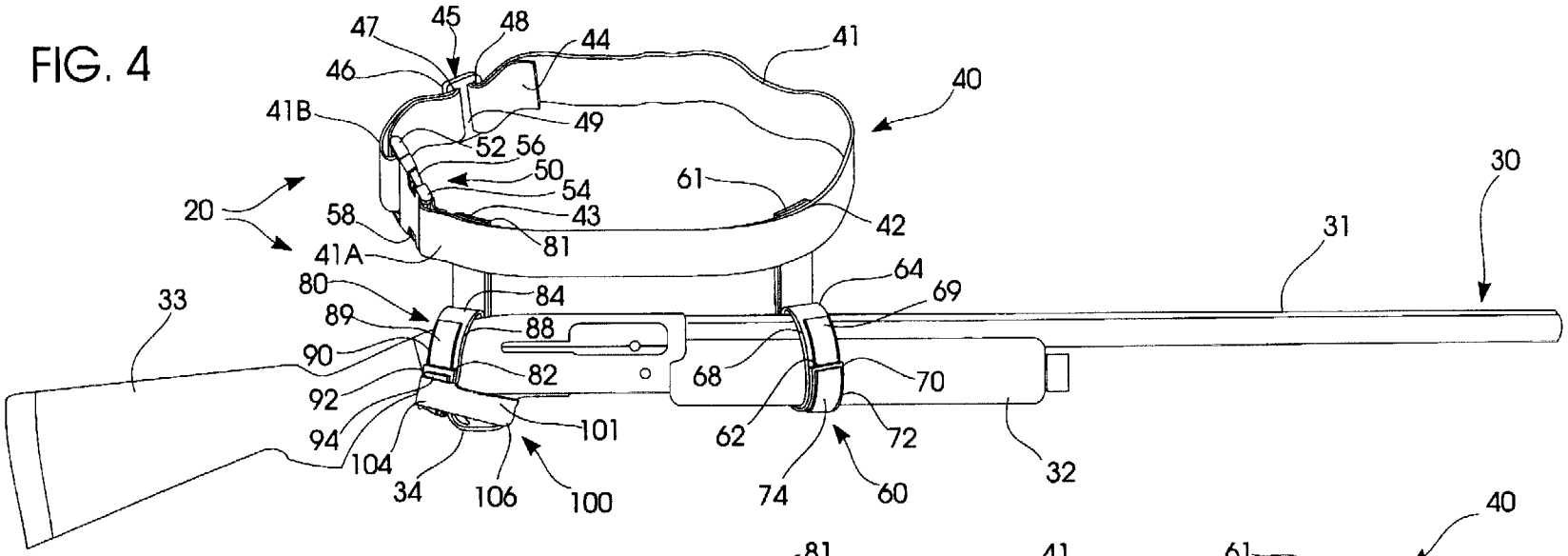
FIG. 4 is an enlarged perspective view of the firearm carrier with a firearm secured thereto, taken generally from the front of the carrier.
Figure 5:
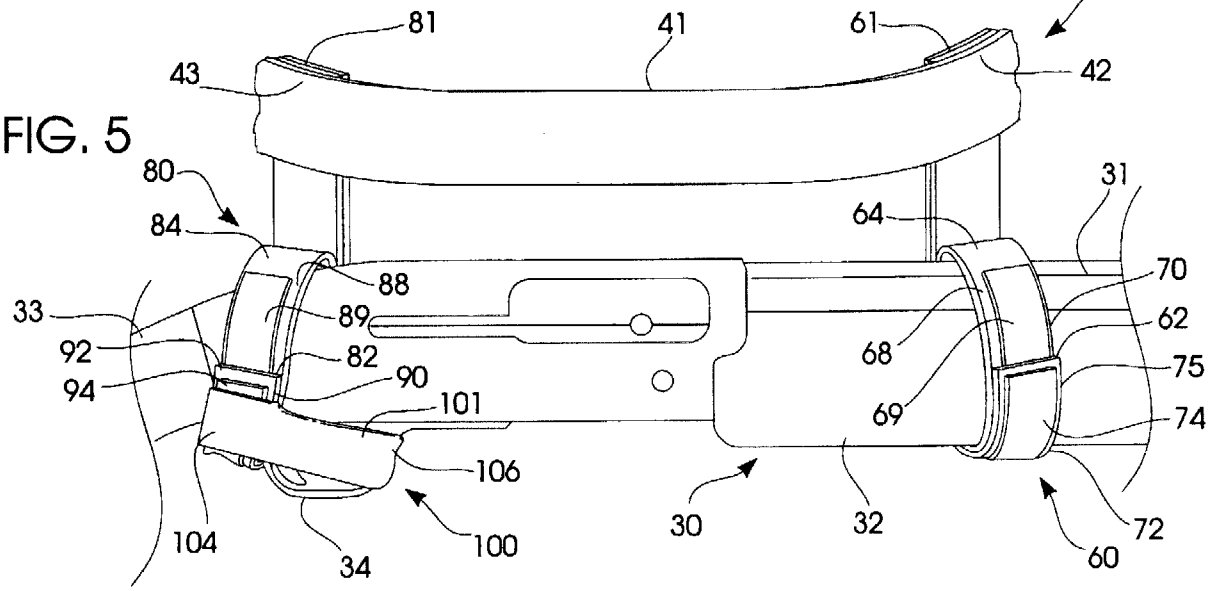
FIG. 5 is an enlarged, partially fragmented view of the firearm carrier and firearm shown in FIG. 4, showing the straps securing the firearm carrier to the firearm and the trigger guard system in closer detail, with portions thereof omitted or broken away for clarity.
Figure 6:
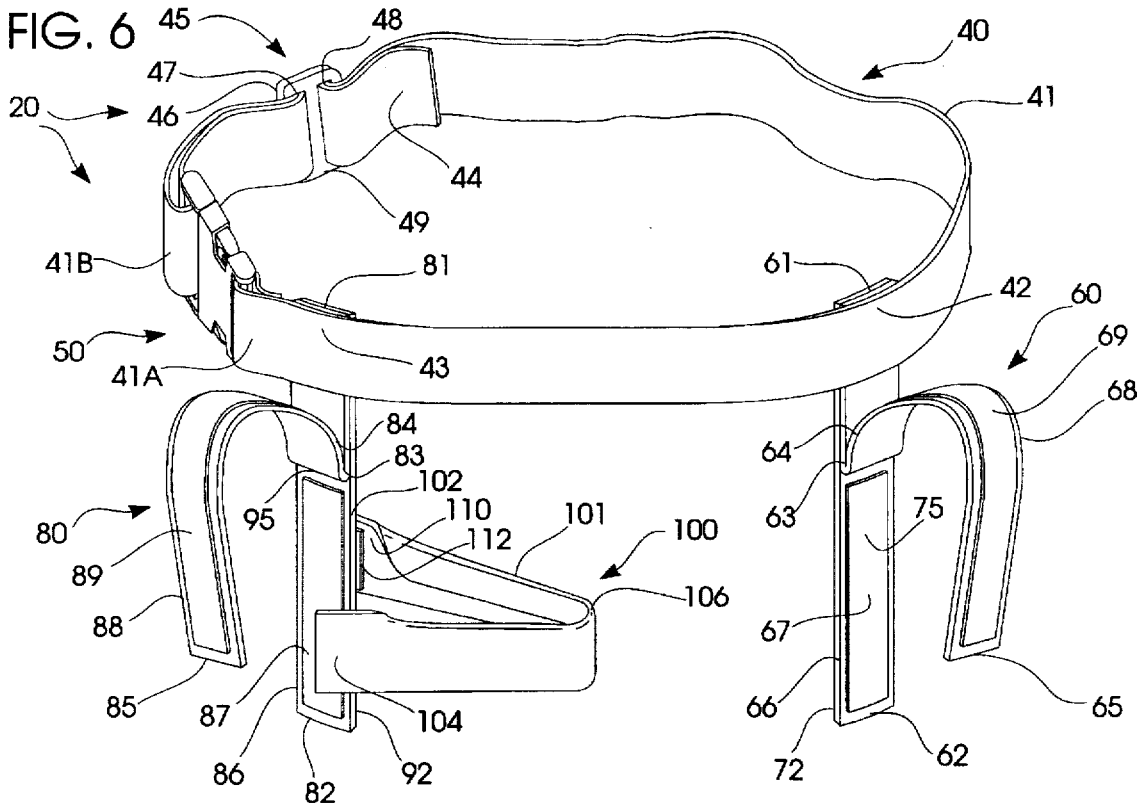
FIG. 6 is an enlarged, partially exploded perspective view similar to FIG. 5, with the firearm removed for clarity and with the trigger guard system partially opened and both straps opened.
Figure 7:
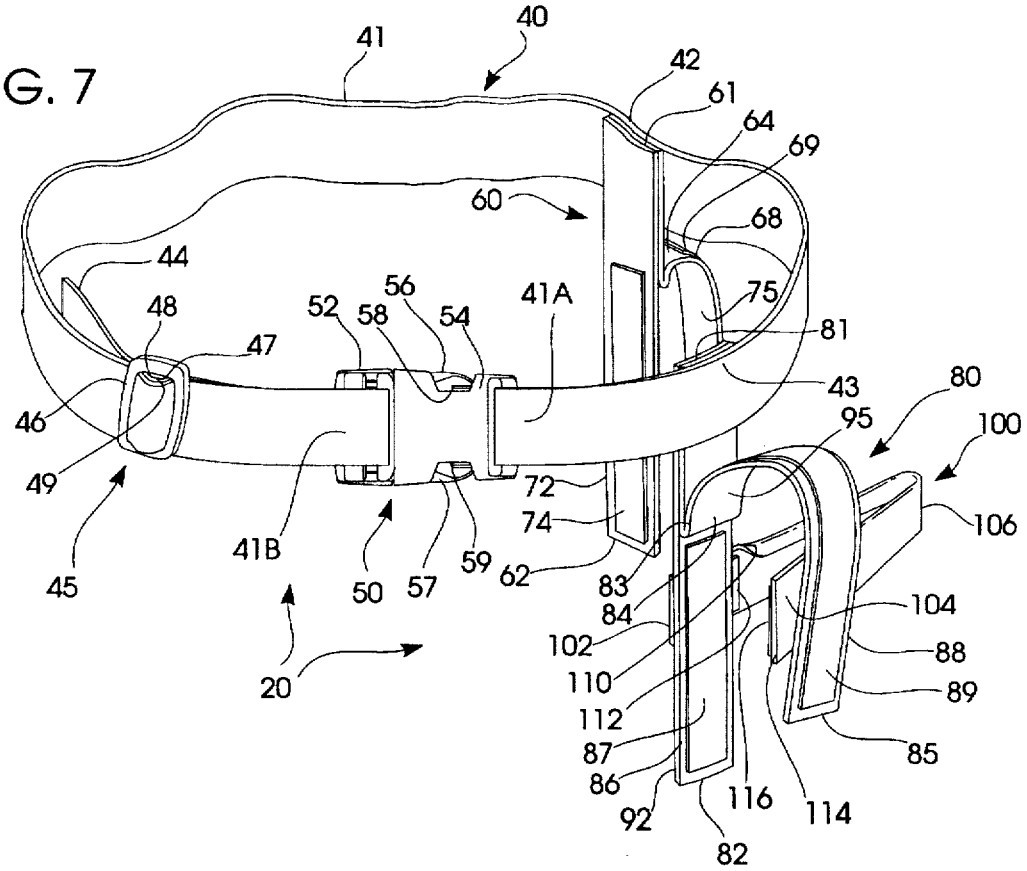
FIG. 7 is a an enlarged, partially exploded perspective view similar to FIG. 6, taken generally from the left side of FIG. 6, with the firearm removed for clarity and with the trigger guard system partially opened and both straps opened.

Referring more specifically to the drawings, the firearm carrier is generally designated by reference numeral 20 in FIGS. 1–9. The firearm carrier 20 is generally worn by a hunter 25 to carry a firearm 30. Normally, the carrier 20 is deployed by the hunter 25 in a transport configuration 22 while driving or riding an all terrain vehicle or ATV 35 (FIG. 1). However, the carrier 20 can also be used by the hunter as a temporary gun rest or sling as well (FIGS. 2–3).

When the hunter 25 is seated on ATV 35, the carrier 20 effectively immobilizes firearm 30 (FIG. 1) in deployed configuration 22. Carrier 20 secures firearm 30 in the hunter's lap 26, partially stabilizing the firearm 30 upon the hunter's legs 27 and 28. One important result of configuration 22 is the increased normalcy in ATV operation as opposed to shoulder sling use or handlebar rack use.

The deployed, transport configuration 22 permits the hunter to maneuver the handle bars 36 normally to steer the ATV. The handlebars 36 are subsequently free from the obstructions that typically result from rack use. The deployed configuration 22 also permits the hunter 25 to sit normally on seat 38. Thus, the carrier 20 permits the hunter 25 to use an ATV 35 normally, without requiring sacrifices of safe ATV operating procedures.

Transport configuration 22 also provides increased protection for firearm 30. Most conventional gun lengths are approximately equal to or smaller than handlebar span 39. Configuration 22 also puts firearm 30 in front of ATV rear 37. The positioning of firearm 30 between handlebars 36 and rear 37 provides the greatest degree of structural protection for firearm 30.

The firearm carrier 20 secures the firearm 30 to the hunter 25 through the cooperative encircled deployment of two retaining straps 60, 80. Preferably, the retaining straps 60, 80 are spaced approximately one foot apart along the carrier. Strap 60 attaches to the front of the gun, normally along barrel 31, preferably on the forearm 32. Conversely, strap 80 attaches to the rear of the gun, normally along the stock 33, preferably adjacent the trigger guard 34. Thus, when straps 60 and 80 are fully deployed, they encircle a front and rear portion of firearm 30, preferably at least one foot apart. An auxiliary trigger guard system 100 prevents an accidental discharge of firearm 30 when attached to one of the straps 60, 80.

The firearm carrier 20 comprises an elongated belt 40 (FIGS. 4–9). Belt 40 comprises an elongated, flat body 41 bounded by buckle ends 41A, 41B. Normally, the belt loops about the hunter's waist 29. Straps 60 and 80 emanate from attachment junctures 42, 43.

Preferably, junctures 42 and 43 are spaced approximately twelve inches apart to accommodate most hunters. Thus, straps 60 and 80 will drape along the centers of the legs 27, 28 of most hunters. This draping lends added stability to transport configuration 22. A terminal adjustment end 44 cooperates with slider 45 to permit adjustment of the encircling length of the belt 40.

Slider 45 comprises a flat plate 46 oriented perpendicularly to the longitudinal axis of body 41. A pair of spaced apart, vertically oriented, narrow channels 47 and 48 penetrate slider 45. A divider 49 separates channels 47 and 48. Adjustment end 44 inserts through channel 47 about divider 49 and out through channel 48 before entering buckle end 41B. Adjustment end loops through buckle end 41B and returns back through channel 48 about divider 49 and out through channel 47 to form a tensioned stop.

A quick release belt buckle assembly 50 selectively permits the coupling of buckle ends 41A to 41B. Buckle end 41A comprises a protruding male coupling 52. Buckle end 41B comprises a grooved female receiver 54. Male ends 56, 57 resiliently snap into a temporary locked position upon reaching openings 58, 59 in the female receiver.

The hunter thus simply loops belt 40 about his waist 29 and inserts male coupling 52 into female receiver 54, causing ends 56 and 57 to be displaced until entering openings 58 and 59. Ends 56 and 57 resiliently protrude from openings 58 and 59, cooperatively mating buckle end 41A to buckle end 41B. The encircling length of belt 40 may be adjusted by pulling adjustment end 44 through slider 45 to shorten or lengthen the length as desired.

Strap 60 depends downwardly from end 61, attached to belt 40 at juncture 42, to terminal end 62. A juncture 63 bisects strap 60 at approximately one-third of the length from end 61 to end 62. An elongated, intermediary leg 64 projects outwardly from juncture 63. Intermediary leg 64 terminates at end 65.

The interior surface 66 between end 62 and juncture 63 is preferably covered by a strip of hook fastener 67. The exterior surface 68 of the intermediary leg 64 between juncture 63 and end 65 is also preferably covered with a cooperative pile fastener 69. Thus, hook fastener 67 and pile fastener 69 may be placed one upon another to form a retention loop 70. The exposed exterior terminal end surface 72 is preferably also covered by a pile fastener 74. Preferably, the strap interior 75 is relatively smooth to protect the gun's finishes.

Strap 80 is very similar to strap 60. Strap 80 depends downwardly from end 81, attached to belt 40 at juncture 43, to terminal end 82. A juncture 83 bisects strap 80 at approximately one-third of the length from end 81 to end 82. An elongated, intermediary leg 84 projects outwardly from juncture 83. Intermediary leg 84 terminates at end 85.

The interior surface 86 between end 82 and juncture 83 is preferably covered by a strip of hook fastener 87. The exterior surface 88 of the intermediary leg 84 between juncture 83 and end 85 is also preferably covered with a cooperative pile fastener 89. Thus, hook fastener 87 and pile fastener 89 may be placed one upon another to form a retention loop 90. The exposed exterior terminal end surface 92 is preferably also covered by a pile fastener 94. Preferably, the strap interior 95 is relatively smooth to protect the gun's finishes.

The trigger guard system 100 comprises an elongated webbing 101 that encircles the trigger guard 34 to prevent an accidental discharge of firearm 30. The system 100 may be selectively attached to either strap 60 or strap 80.

Figure 8:
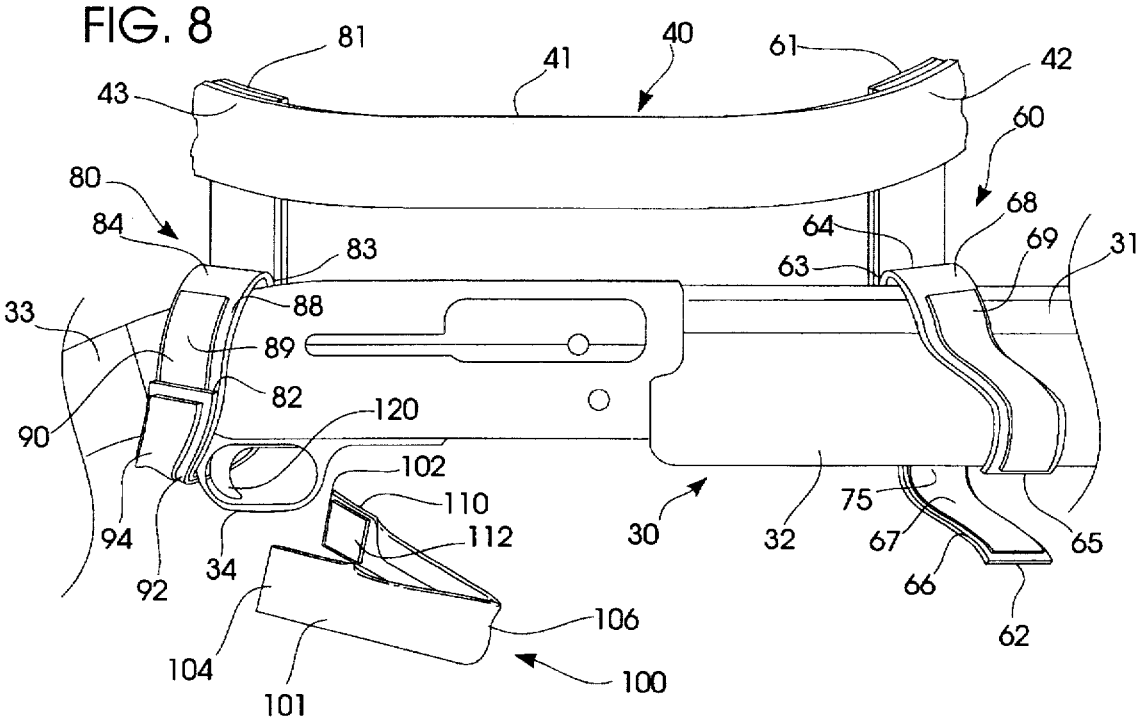
FIG. 8 is an enlarged, partially exploded and partially fragmented view of the firearm carrier and firearm similar to FIG. 5, with one strap opened and with the trigger guard system removed, with portions thereof omitted or broken away for clarity; and, FIG. 9 is an enlarged, partially exploded and partially fragmented view of the firearm carrier and firearm similar to FIGS. 5 and 8 but with a left-handed firearm to show the interchangeability of the trigger guard assembly and the firearm carrier, with one strap opened and with the trigger guard system removed, with portions thereof omitted or broken away for clarity.
Figure 9:
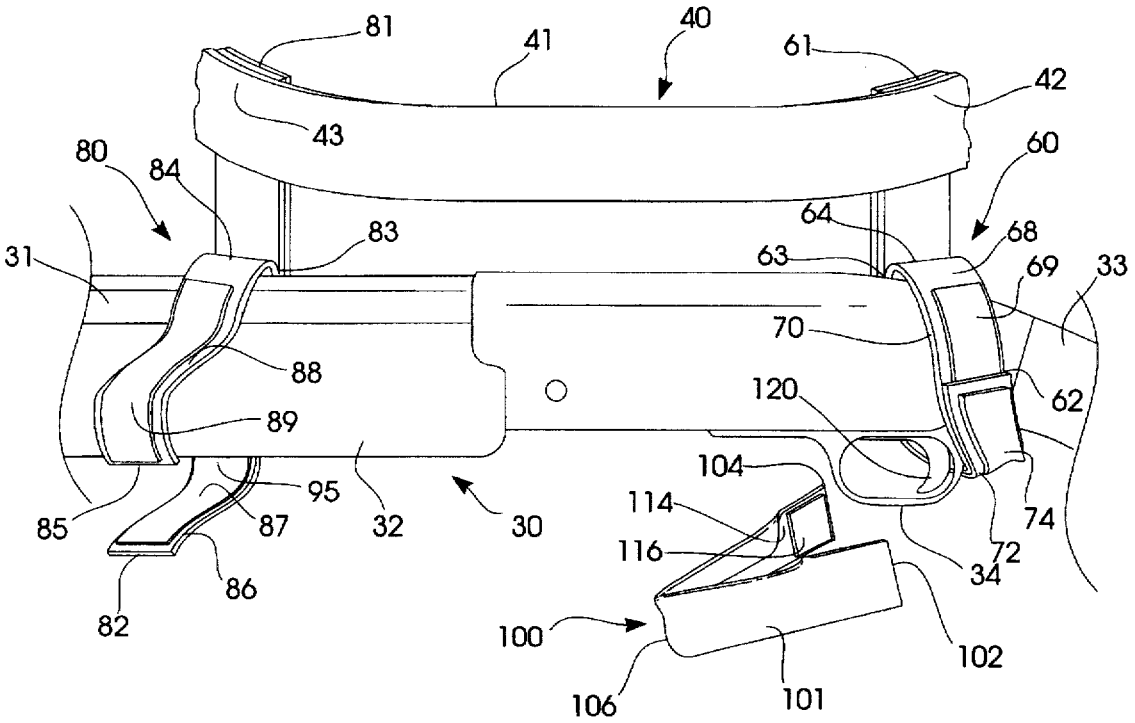

Webbing 101 has two spaced apart ends 102, 104 equidistant from a creased midpoint 106. The ends 102, 104 may be selectively attached to either straps 60 or strap 80 in an identical fashion (FIGS. 8–9).

End 102 and 104 attach to either pile fastener 74 or 94. Preferably, interior surface 110 of end 102 is covered by a mating hook fastener 112 and interior surface 114 of end 104 is covered by another hook fastener 116. Hook fasteners 112 and 116 both cooperatively couple to either exposed pile fasteners 74 or 94 on strap 60 and 80, respectively.

OPERATION

The deployment of carrier 20 is best shown in FIGS. 1–3 and 8–9. As discussed above, a hunter 25 typically uses the carrier 20 when riding ATV 35. However, carrier 20 may also serve as a temporary gun rest (FIG. 2) or as a temporary sling (FIG. 3).

Preferably, the carrier 20 is put on by the hunter 30 about their waist 29 before gun 30 is attached. Gun 30 is secured to carrier 20 by looping straps 60 and 80 about the forearm 32 and stock 33 and then fastening the straps to form retention loops 70 and 90.

First, gun 30 is placed against strap interiors 75 and 95. Then, intermediary legs 64 and 84 are looped about gun 30 (at forearm 32 and stock 33). Finally, terminal ends 62 and 82 are placed over intermediary ends 65 and 85 and fastened thereto, forming retention loops 70 and 90. Retention loops 70 and 90 secure gun 30 to carrier 20.

Trigger guard system 100 may optionally be attached to either strap 60 or 80 on retention loop 70 or 90, respectively. Ends 102 and 104 of webbing 101 encircle trigger guard 34 to prevent access to trigger 120. Thus, trigger guard system 100 prevents an accidental discharge of gun 30.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A firearm carrier for transporting firearms, said carrier comprising:

a generally circular belt adapted to be tightened about a wearer's waist, said belt comprising means for adjusting the length thereof and buckle means for securing said belt about the wearer's waist;

a pair spaced apart, adjustable straps suspended from said belt for encircling at least a portion of the firearm to be transported and wherein said straps encircle and grasp said firearm whether or not said buckle means is deployed, said straps being positioned in alignment with the legs of the wearer so that the firearm is disposed in a generally horizontal transportation configuration in the lap of the wearer when seated; and, trigger guard means temporarily coupled to one of said straps for preventing accidental discharge of said firearm, said trigger guard means comprising an elongated webbing having spaced apart ends and coupling means associated with each end of said webbing for temporarily securing said trigger guard to one of said straps.

2. The carrier as defined in claim 1 wherein said coupling means comprises hook and pile fasteners.

3. A firearm carrier comprising:

a generally circular belt adapted to be tightened and worn about the user's waist, said belt comprising means for adjusting the length thereof and buckle means for securing the belt to the user's waist;

a pair of downwardly projecting straps of adjustable length spaced apart from one another and suspended from said belt, each strap comprising a terminal end adapted to be looped about at least a portion of a firearm to be transported to support it horizontally transversely relative to the user; and, trigger guard means temporarily coupled with one of said straps for preventing accidental discharge of said firearm, said trigger guard means comprising an elongated webbing and coupling means associated with said webbing for temporarily securing said trigger guard to one of said straps.

4. The firearm carrier as defined in claim 3 wherein said coupling means comprises hook and pile fasteners.

5. A firearm carrier enabling a seated rider of an all terrain vehicle ATV to transport firearms, said carrier comprising:

belt means for securing said carrier to the rider's waist;

a pair of downwardly projecting straps of adjustable length spaced apart from one another and attached to said belt means, each strap comprising a terminal end adapted to be looped about at least a portion of a firearm to suspend it from the rider above the ATV and wherein said straps are positioned in alignment with the legs of the rider to dispose the firearm in a generally horizontal transportation configuration in the lap of the rider when seated on said ATV; and, trigger guard means for preventing accidental discharge of said firearm, said trigger guard means comprising an elongated webbing and coupling means associated with said webbing for temporarily securing said trigger guard to one of said straps.

* * * * *